US006186796B1

(12) United States Patent
Wedge

(10) Patent No.: US 6,186,796 B1
(45) Date of Patent: Feb. 13, 2001

(54) SWIVEL DEVICE FOR A WINDCONE TOWER ASSEMBLY

(76) Inventor: Larry Paul Wedge, Box 400, Brackendale B.C. (CA), V0N IH0

( * ) Notice: Under 35 U.S.C. 154(b), the term of this patent shall be extended for 0 days.

(21) Appl. No.: 09/271,789

(22) Filed: Mar. 18, 1999

(30) Foreign Application Priority Data

Dec. 10, 1998 (CA) ..... 2255430

(51) Int. Cl.[7] ..... H01R 39/00
(52) U.S. Cl. ..... 439/11; 340/949
(58) Field of Search ..... 439/71, 13, 18, 439/19, 20, 21, 22, 23, 24, 25, 26, 27, 14, 15, 16; 73/188.1, 189; 340/949

(56) References Cited

U.S. PATENT DOCUMENTS 4,423,549 * 1/1984 King ..... 29/597
4,486,754 * 12/1984 Guggemos ..... 340/949
4,847,528 * 7/1989 Eguchi et al. ..... 310/239
4,871,049 * 10/1989 Okita ..... 192/21.5
5,833,482 * 11/1998 Buchter ..... 439/288

* cited by examiner

*Primary Examiner*—Paula Bradley
*Assistant Examiner*—Alexander Gilman
(74) *Attorney, Agent, or Firm*—Frederick Kaufman

(57) ABSTRACT

A swivel device for a wind cone tower assembly comprises a rotating housing, provided with channels for drainage of condensation from its interior, and a fixed axle on which this housing is mounted. Two split bushings of insulated material are offset placed on each other between the surface of the fixed axle and a pair of slip rings. Brushes with enhanced content of copper are used and an insulating coating is applied around the brush holders to prevent electrical leakage. A conductor bushing also of insulating material for protecting the electrical conductors extending perpendicularly from the interior of the fixed axle to the pair of slip rings mounted on this axle.

8 Claims, 6 Drawing Sheets

SWIVEL DEVICE FOR A WINDCONE TOWER ASSEMBLY

BACKGROUND OF THE INVENTION

1. Field on the Invention

The present invention relates in general to windcone lighting devices and, in particular, to swivel devices.

2. Description of the Prior Art

Various types of windcones to indicate wind direction and velocity have been in use at airports around the world. Normally, these windcones, being rotatably about a vertical axis mounted on an upright pole, utilize a truncated conical framework provided with a windsock. The air current passing through the windsock causes it to distend leewardly and point windwardly. The degree of expansion of a windsock, by the wind passage, constitutes an indicator of the wind velocity.

Since aircraft landing occurs both in daylight and at night, it is critical that windcones be well illuminated for night time visibility. Therefore, a lighting fixture, comprising a bulb, is adapted to illuminate the interior of the windsock directly, and thereby, to provide an indication of the wind direction and velocity, even in hours of darkness. The windsock is formed from a suitable fabric material, so that the light rays from the bulb would be visible through the cone.

As can be seen from the above, the use of a single light, that directly illuminates the windcone with which it rotates, provides adequate illumination, regardless of the wind direction The connection between the upper part of the fixed upright pole and the rotatably mounted windcone and the connection between a fixed electrical power supply and the light fixture, which rotates with the cone, is provided by a swivel device. This device, which constitutes the most important part of a windcone assembly, is exceptionally vulnerable due to its direct exposure to unobstructed heavy wind, rain, snow and, implicitly, changes of temperature.

Attempts have been made in the past to introduce a better swivel device. U.S. Pat. No. 4,553,430, dated Nov. 19, 1985 and granted to Behrens for "Illuminated windsocks for airports" teaches the use of a spotlight bulb directed along the horizontal axis of the windsock. The bulb may be mounted directly to a rotating axle, coaxially with the supporting post, or can be carried by radial arms attached to the circular framework of the windsock. There are obvious disadvantages to Behren's design. First, the electrical fixture, used for illumination, is energized by electrical conductors which terminate in conventional alligator-type electric clips, slidably attached to a slip ring assembly. It is known that the use of brushes is more reliable and efficient. Second, use is made of an upright axle with upper and lower bearings, rotatably supported on the axle. Each of the bearings has a radially extending rod which is welded to a rim of windsock framework. Thus, the distance between the bearings is substantial, the length of the upright axle being commensurate with the larger diameter of the windsock. Due to this design and to the fact that the assembly, alligator clips-slip rings, is located beyond the two bearings, above the upper one, this device lacks compactness.

U.S. Pat. No. 4,486,754, dated Dec. 4, 1984 and granted to Guggemos for a "Lighted windcone for evacuation aid" discloses a windcone lighting device. Here, a tubular shaft is mounted on top of an upright pole, firmly attached to a base. The windcone is rotatably mounted on the tubular shaft, the mounting comprising a pair of vertically spaced bearings. A bracket is attached to each outer race of these bearings for joining and rotating with the windcone. An assembly, slip rings-brushes is located above the upper bearing. A lamp support conduit, which assumes a generally "J" shape, connects the brushes to a light and rotates with the windcone. In another embodiment, there is lamp support located between the brackets, within the windcone. Guggemos structure has the same shortcomings as Behrens structure Moreover, the use of a lamp support conduit or a lamp support which do not form a unitary rigid structure with the slip rings-brushes assembly constitutes another shortcoming.

SUMMARY OF THE INVENTION

There is, accordingly, a need for a swivel device which overcomes or, at least alleviates, the disadvantages of the prior art.

The present invention is basically directed to a swivel device which comprises a rotating housing, provided with means for drainage of condensation from its interior to its exterior, and a fixed axle on which the rotating housing is supported through two spaced bearings. Used is made of means for providing electrical insulation between a pair of slip rings and the fixed axle, while in the interior of the rotating housing, brush means is attached. There is also means for preventing electrical leakage from or to the brush means, and for protecting electrical conductors extending from the interior of the fixed axle to the pair of slip rings.

In one aspect of this invention, the rotating housing has an upper, reduced diameter cavity and a lower, larger diameter cavity. In the lower, larger diameter cavity is provided in its wall, along its whole length, a longitudinal channel for collecting and draining condensation and allow breathing. The lower, larger diameter cavity is also provided, laterally, with an opening which ends in a machine finished surface. To this surface is attached a flange cover. A drainage slot is indented in the machine finished surface, at its lower end, parallel to the longitudinal axis of the rotating housing. When the flange cover is attached to the machined surface, a connecting passage between the interior of the lower, larger diameter cavity and the exterior is formed.

In another aspect of this invention, the fixed axle is of hollow type and is provided with a bore which starts from the middle of the surface of its central position and extends inwardly, perpendicular to the longitudinal axis of the fixed axle, until it reaches its hollow interior.

In another aspect of this invention, the means for providing electrical insulation between the fixed axle and the pair of slip rings includes a first split bushing mounted directly on the fixed axle, between the two bearings. A second split bushing, made also of insulating material is mounted on the first split bushing with its slit coinciding with the bore in the fixed axle. The position of the slit of the first split bushing is offset with respect to the slit of the second split bushing. The second split bushing is provided with two circular channels for snuggly fitting the pair of slip rings.

In another aspect of this invention, the brush means includes brushes of carbon impregnated with 50% copper. The brushes are located in brass guides which are pressed in brush holders. The brush holders are introduced and firmly attached in a brush holder carrier which is attached to the rotating housing to face the pair of slip rings.

In another aspect of this invention, the means for preventing electrical leakage from and to the brush means includes an insulating coating. This coating is applied on the surface of the brush holder carrier which faces the pair of slip rings, and, especially, around the brush holders.

In another aspect of this invention, the means for protecting electrical conductors, which extend from the interior of the fixed axle to said pair of slip rings, includes a conductor bushing of insulating material which passes through the slit of the second split bushing and is also inserted in the first split bushing and in the bore of the fixed axle.

BRIEF DESCRIPTION OF THE DRAWINGS

In drawings which illustrate the embodiment of the invention.

DESCRIPTION OF A PREFERRED EMBODIMENT

Figure 1:
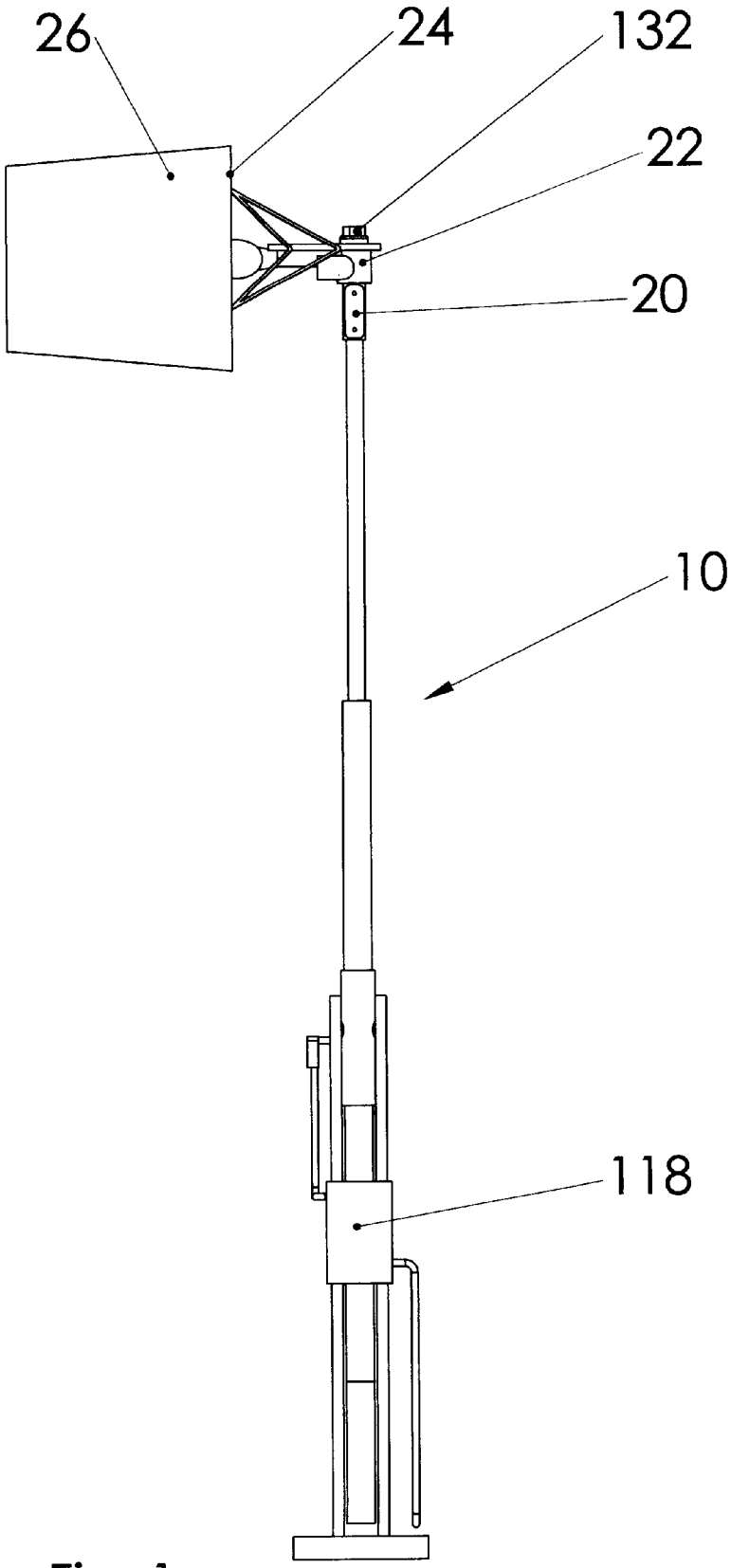
FIG. 1 is a front elevation view of a windcone tower assembly.
Figure 2:
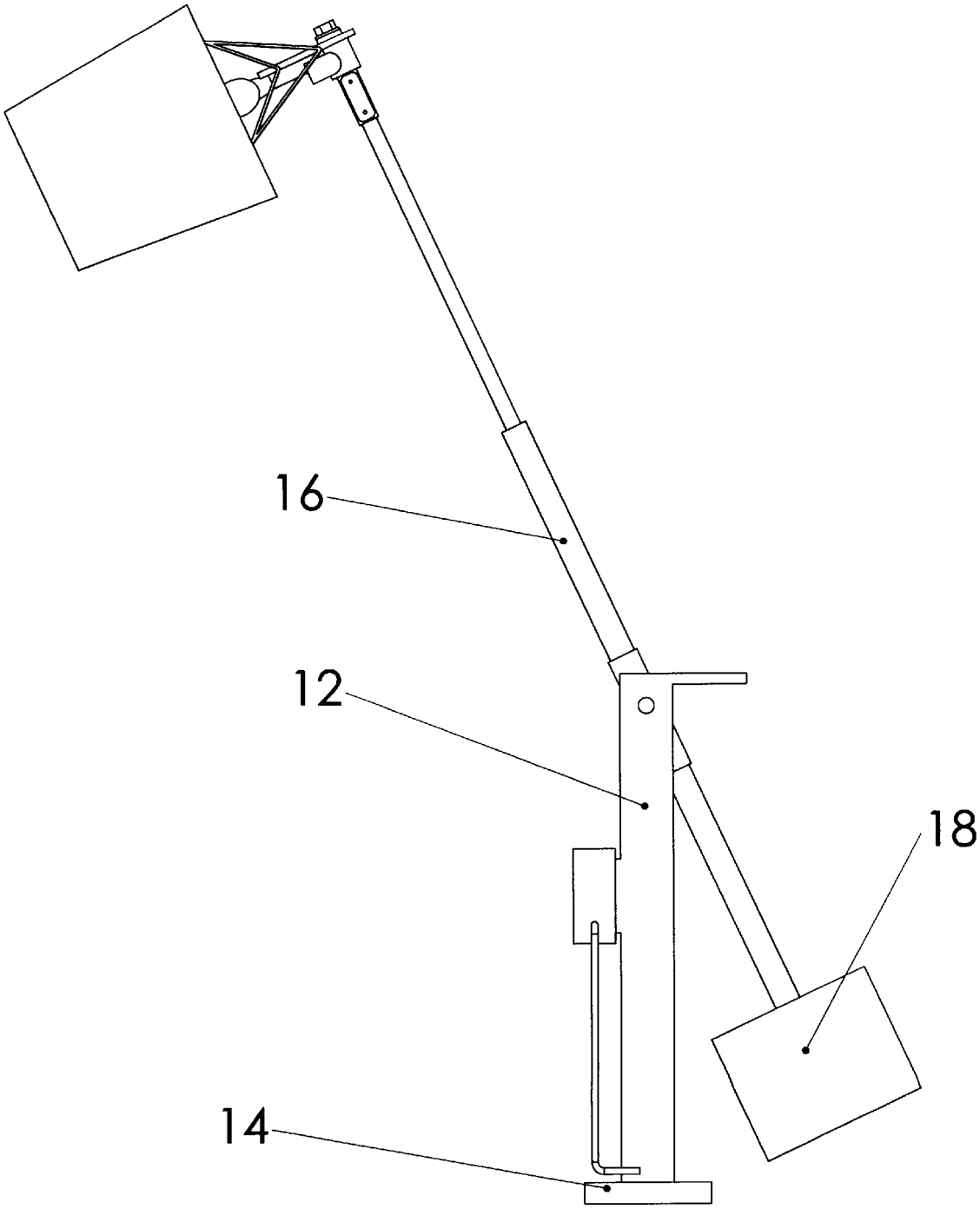
FIG. 2 illustrates partly a side elevation view of the above assembly, shown with its upright support post, foundation and counter weight.
Figure 3:
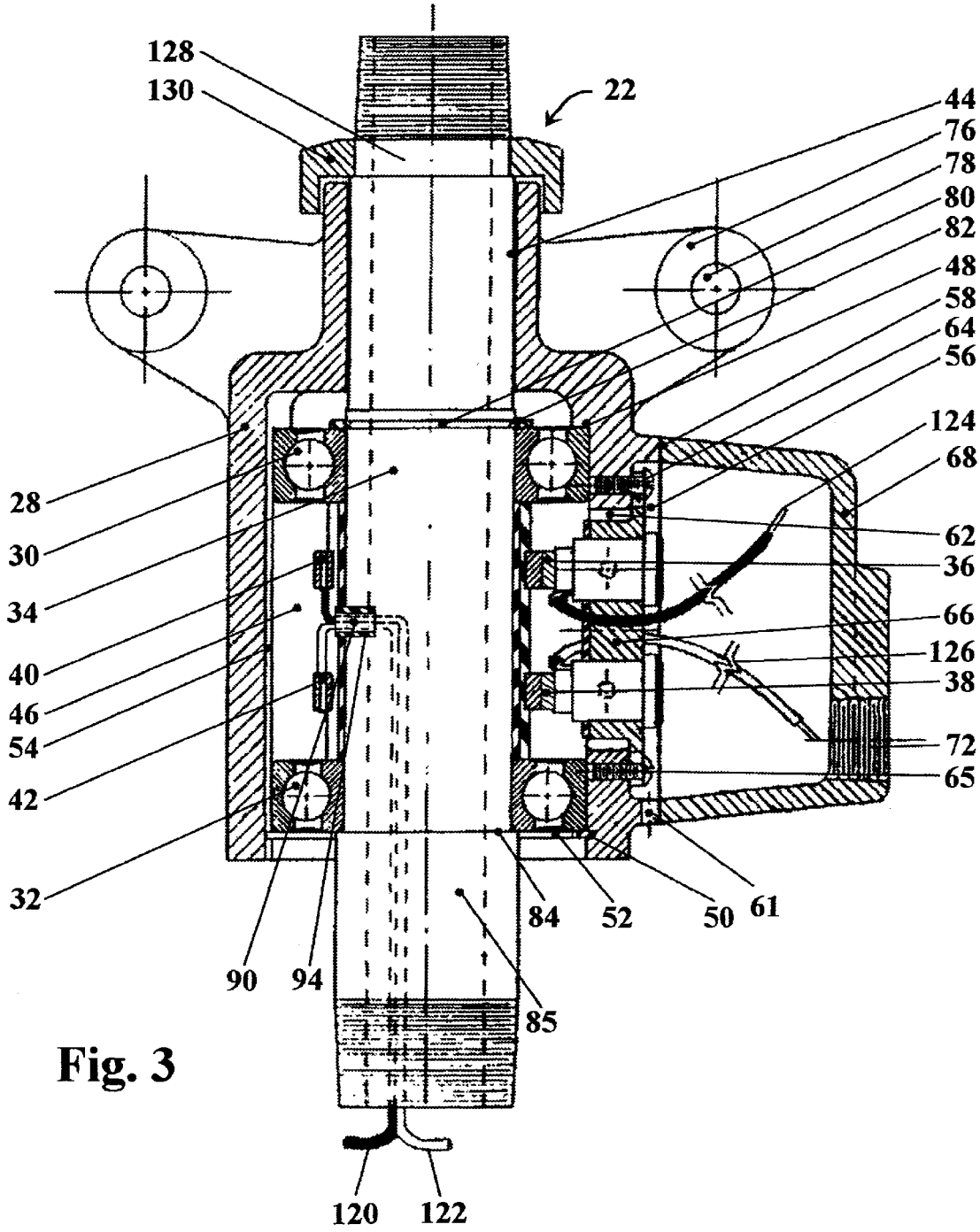
FIG. 3 is the swivel device shown in a section of the line III—III of FIG. 4.
Figure 4:
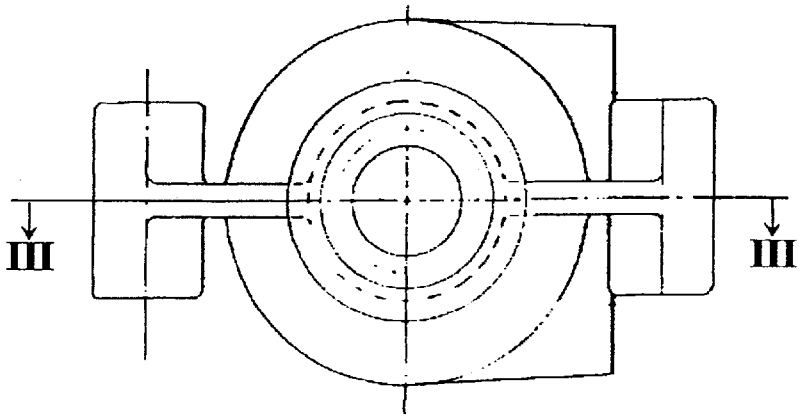
FIG. 4 is a top view of the swivel device.
Figure 5:
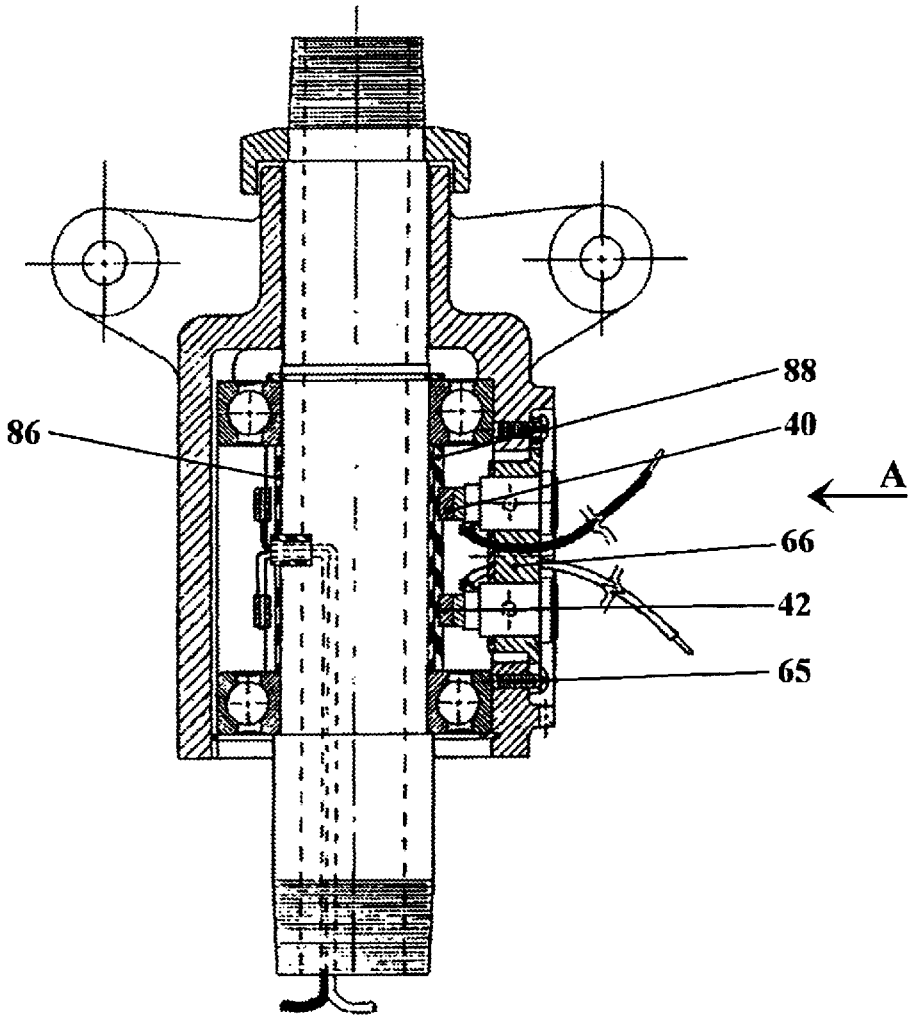
FIG. 5 is the swivel device of FIG. 3 with the flange cover removed.
Figure 6:
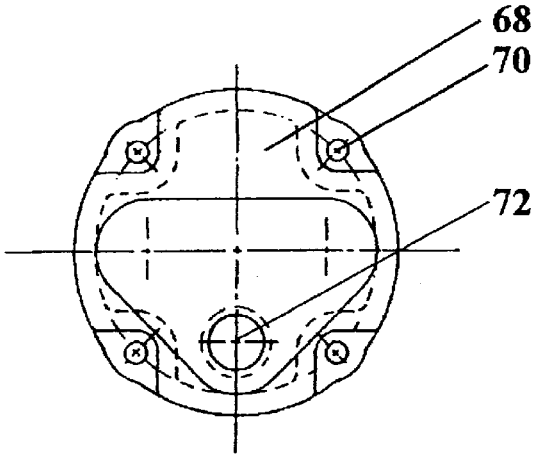
FIG. 6 is the flange cover shown in elevation.
Figure 7:
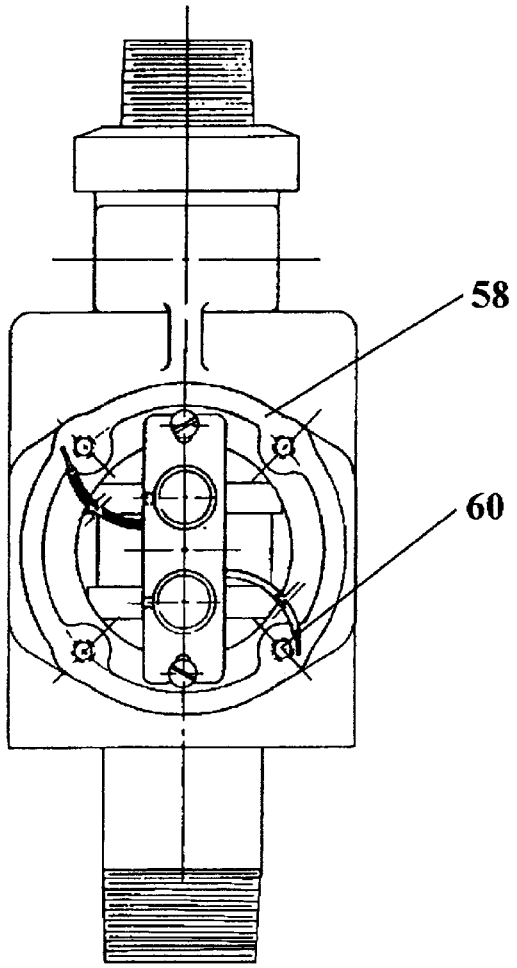
FIG. 7 is the view of FIG. 5 (see arrow A) where the slip rings and brush holder carrier are shown.
Figure 8:
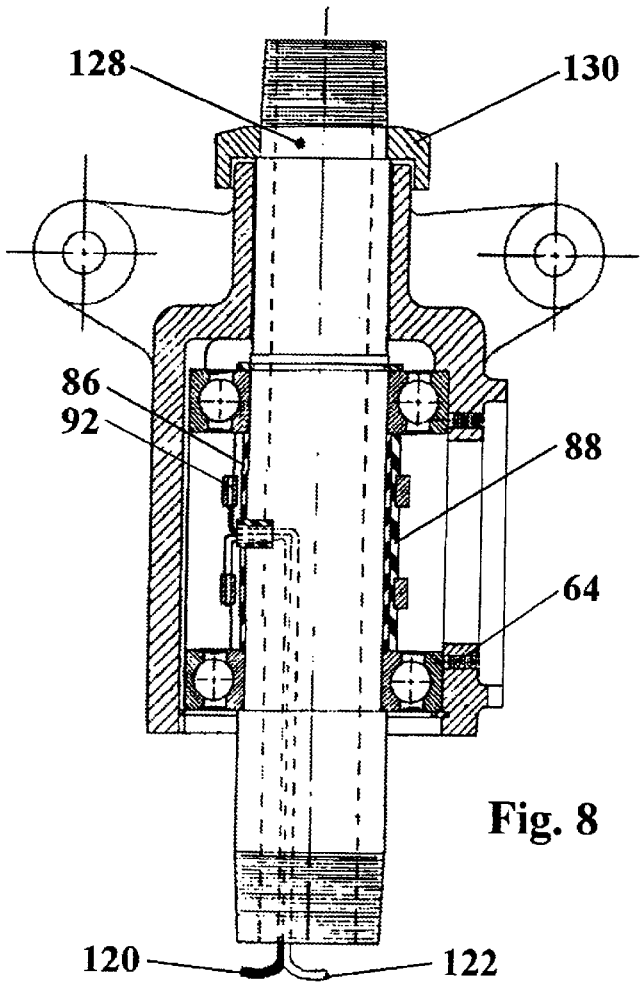
FIG. 8 is the swivel device of FIG. 3 with the brush holder carrier and flange cover removed.
Figure 9:
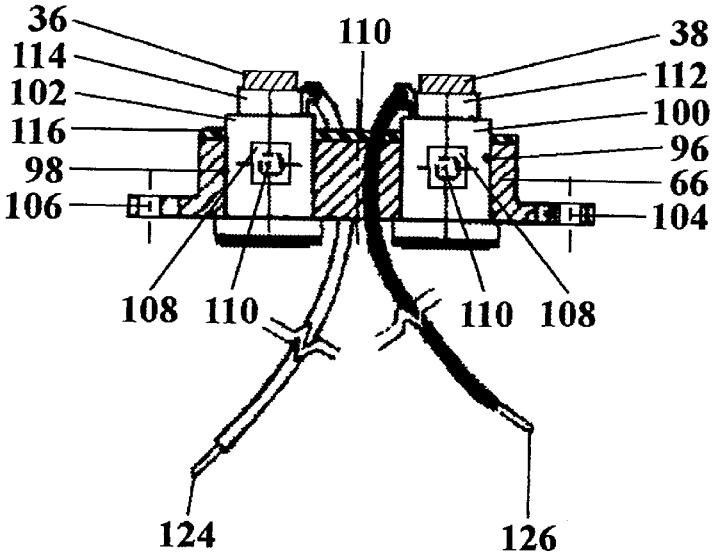
FIG. 9 is a longitudinal cross section of the brush holder carrier.

The structure and function of the invention will become apparent from the following detailed description and from the appended drawings in which like numbers have been used to describe like parts of the several views.

Referring to the drawings, in a preferred embodiment, the subject invention comprises a windcone tower assembly 10 having an upright support post 12, anchored to a foundation 14.

A hollow pole 16, provided at its lower end with a counter weight 18, is pivotably attached to support post 12. At the upper end of hollow pole 16, there is firmly attached a connection member 20, to which a swivel device 22 is joined. To swivel device 22 is laterally attached a truncated conical framework 24, which is covered by a sock 26.

Swivel device 22 comprises a rotating housing 28 which rotates freely on two double-sealed, prelubricated radial ball bearings 30 and 32, mounted on a fixed axle 34.

Rotating housing 28 carries two electrically connected brushes 36 and 38, while fixed axle 34 carries two sliprings 40 and 42. Brushes 36 and 38 align with and electrically engage slip rings 40 and 42, respectively.

Rotating housing 28 has an elongated, rigid structure, and is cast, then heat-treated, of aluminum alloy AL 6061 T6. This rotating housing 28 has an upper cavity 44 and a lower, larger diameter, cavity 46. Both cavities 44 and 46 are cylindrical. Since in lower, larger diameter cavity 46 outer races of ball-bearings 30 and 32 are mounted, cavity 46 is precisely bored through, to assure a high degree of accuracy.

The outer races of ball-bearings 30 and 32 are fitted onto larger diameter cavity 46 with an interference.

The upper end of cavity 46 ends with a shoulder 48 for holding, against axial displacement, the outer race of ball bearing 30. Cavity 46 is also provided, close to its lower end, with a circular groove 50 for locating an internal snap ring 52 for holding the outer race of ball bearing 32 against axial displacement. Cavity 46 has, as well, in its wall, along its whole length a longitudinal channel 54 for collecting and draining condensation and permit breathing.

Laterally, cavity 46 has an opening 56 which ends with a machine finished surface 58 and is provided with four threaded grooves 60. A drainage slot 61 is indented in machine finished surface 58, at its lower part, parallel to the longitudinal axis of rotating housing 28. Thus, when flange cover 68 is attached to machined surface 58 a connecting passage between the interior of rotating housing 28 and the exterior is formed. Opening 56 has a recessed portion 62 with two threaded holes 64 for locating and, respectively, attaching with screws 65 a brush holder carrier 66. A flanged cover 68 is provided with four holes 70, corresponding to four threaded holes 60, and a threaded opening 72 for an electrical fixture (not shown). Four bolts 74 (not shown) are used to join flanged cover 68 to machine finished surface 58 of housing 28.

Rotating housing 28 is provided with side hinge brackets 76, located oppositely at each side of its upper part, from which they extend and with which they form a unitary, rigid casing. Each side hinge 76 has a bushing 78 for joining truncated conical framework 24.

Fixed axle 34 is of hollow type and is made of cadmium plated steel. Its upper and lower ends are threaded, while its central portion for mounting the inner races of double-sealed, prelubricated, radial ball bearings 30 and 32 and sliprings 40 and 42 is machined to a high degree of accuracy. The central portion of fixed axle 34 ends upwards with an annular channel 80 for fastening an external snap ring 82. The same central position of fixed axle 34 ends downwards with a step 84 formed by a portion of axle 85 which has a larger diameter than the rest of axle 34.

The inner race of lower ball bearing 32 is held axially by step 84.

The inner races of ball bearings 30 and 32 are mounted on fixed axle 34 with a slip fit. The inner race of upper ball bearing 30 presses against external snap ring 82, which is fastened to axle 34; the inner race of lower ball bearing 32 presses against step 84. Additionally, the distance between inner races is kept constant by a first and second split bushings 86 and 88, which are rigid and superimposed on axle 34. Besides their role as an electrical insulator, they act as a separator between ball bearings 30 and 32. Thus, the rotation of inner races of ball bearings 30 and 32 with respect to axle 34 and the axial displacement of these races on axle 34 are prevented A bore 90, which starts from the middle of the external surface of the central portion of fixed axle 34 and extends inwardly, perpendicular to the longitudinal axis of axle 34, is provided.

On fixed axle 34, between the inner races of ball bearings 30 and 32, first split bushing 86 is mounted. First split bushing 86 is a slip ring insulator made of DMD (Dacron-Mylar-Dacron)—all trade marks—and has a thickness of 14 mils.

Second split bushing 88 is mounted on first split bushing 86 and constitutes a slipring holder, made of polyurethane REDCO 750 (REDCO is a trademark).

On the exterior of second split bushing 88 there are two parallel circular channels 92 for snuggly fitting slip rings 40 and 42. Second split bushing 88 has its slit coinciding with bore 90, while the slit of first split bushing is offset. A conductor bushing 94, made of polypropylene, passes through the slit of second split bushing 88 and is also inserted in first split bushing 86 and in bore 90.

Due to the relative position of first and second split bushings 86 and 88, the whole surface of fixed axle 34, in the zone of contact between slip rings 40 and 42 and brushes 36 and 38, is electrically insulated.

Brush holder carrier 66 is made of aluminum AL 6061, has an elongated form with two transversal, cylindrical holes 96 and 98 for inserting brush holders 100 and 102 and is provided at its extremities with slots 104 and 106 for screws 65. Brush holders 100 and 102 are tubular and made of bakelite. They are provided exteriorly with opposite facets 108. A threaded screw 110 is inserted laterally in brush holder carrier 66, for each brush holder 100(102), to keep it immobilized. In each brush holder 100(102) is pressed a brass guide 112(114). In each brass guide 112(114), a brush 36(38) is located. Brushes 36 and 38 are made of carbon impregnated with 50% copper (grade 750).

The upper surface of brush holder carrier 66, which faces two slip rings 40 and 42 and, especially, where brush holders 100 and 102 engage brush holder carrier 66, is provided with a coating of epoxy 116. Three layers of GLIPTOL (trademark) are applied. Alternatively, a tape in the form of brush-on electrical tape is applied. This prevents, by sealing out moisture, possible electrical leakage from or to said brushes 36 and 38.

The circuit for supplying electrical current to swivel device 22 is the following:

From a constant brightness transformer 118 with raintight enclosure, attached to upright support post 12, two electrical conductors (not shown) are brought to and suspended in connection member 20. There, the two electrical conductors are joined respectively to a first and second conductor 120 and 122, which throughout the interior of fixed axle 34 and conductor bushing 94 reach slip rings 40 and 42 to which they are attached by soldering.

To each brass guide 112 and 114, where they protrude from the upper surface of brush holder carrier 66, there are soldered wires 124 and 126, respectively, which lead to an electrical fixture for illuminating (not shown).

As mentioned above, fixed axle 34 has its upper and lower ends threaded.

Under the upper threaded end, fixed axle 34 has a cylindrical portion 128, which extends out of housing 28. On cylindrical portion 128, a seal cap 130, made of aluminum, is shrunk fitted. Seal cap 130 prevents moisture to penetrate into upper cavity 44 of housing 28, while permitting the interior of housing 28 to breathe.

The upper threaded end of fixed axle 34 can be used to attach a stationary light connection (not shown) or can be covered by a threaded rain cap 132. Threaded rain cap 132 protects the interior of fixed axle 34 against rainwater penetration.

The lower threaded end of fixed axle 34 is attached to connection member 20.

Connection member 20 ends downwardly with a cylindrical part transversed by a bolt having at its end a nut (all not shown). The cylindrical part can be used exteriorly or interiorly for different sizes of poles.

The embodiments of the invention in which an exclusive property or privilege is claimed are defined as follows:

1. A swivel device for a windcone tower assembly comprises, in combination a rotating housing provided with means for drainage of condensation from its interior to its exterior, said means for drainage being located in a wall of a lower cavity of said rotating housing;

attaching means extending from said rotating housing and adapted to connect a windcone;

a fixed axle on which said rotating housing is supported, at its extremities, through two spaced bearings;

means for providing electrical insulation between a pair of slip rings and said fixed axle;

brush means attached in the interior of said rotating housing and located substantially in a zone between said bearings;

means for preventing electrical leakage from or to said brush means; and means for protecting electrical conductors extending from the interior of said fixed axle to said pair of slip rings.

2. A swivel device for a wind cone tower assembly, as defined in claim 1, wherein said rotating housing has an upper, reduced diameter cavity and a lower, larger diameter cavity, in said lower, larger diameter cavity being provided in its wall, along its whole length, a longitudinal channel for collecting and draining condensation and permitting breathing, said lower, larger diameter cavity is also provided, laterally, with an opening which ends in a machine finished surface for attaching a flange cover, and a drainage slot is indented in said machine finished surface, at its lower part, parallel to the longitudinal axis of said rotating housing, hereby when said flange cover is attached to said machine surface, a connecting passage between the interior of said lower, larger diameter cavity and the exterior is formed.

3. A swivel device for a windcone tower assembly, as defined in claim 1, wherein said fixed axle is of hollow type and is provided with a bore which starts from the middle of the surface of its central portion and extends inwardly, perpendicular to the longitudinal axis of said fixed axle, until it reaches its hollow interior.

4. A swivel device for a windcone tower assembly, as defined in claim 1, wherein said means for providing electrical insulation between said fixed axle and said pair of slip rings includes a first split bushing mounted directly on said fixed axle, between said two bearings, a second split bushing also of insulating material mounted on said first split bushing and having its slit coinciding with said bore in said fixed axle, the portion of the slit of said first split bushing being offset with respect to the slit of said second split bushing, and said second split bushing, being also used as a sliprings holder, is provided with two parallel circular channels for snuggly fitting the pair of slip rings.

5. A swivel device for a windcone tower assembly, as defined in claim 4, wherein said first split bushing is made of DMD (Dacron-Mylar-Dacron), while said second split bushing is made of polyurethane, such as REDCO polyurethane 750.

6. A swivel device for a windcone tower assembly, as defined in claim 1, wherein said brush means includes brushes of carbon impregnated with 50% copper, said brushes being located in brass guides, which are pressed in brush holders, said brush holders being introduced and firmly attached in a brush holder carrier, which brush holder carrier is attached to said rotating housing to face said pair of slip rings.

7. A swivel device for a windcone tower assembly, as defined in claim 6, wherein said means for preventing electrical leakage from said brush means comprises an insulating coating on the surface of said brush holder carrier which faces said pair of slip rings, and especially around said brush holders, where they are inserted in said brush holder carrier.

8. A swivel device for a windcone tower assembly, as defined in either of claims 4 or 5, wherein said means for protecting electrical conductors which extend from the interior of said fixed axle to said pair of slip rings, comprises a conductor bushing of insulating material which passes through the slit of said second split bushing and is also inserted in said first split bushing and in said bore of said fixed axle.

* * * * *